US005327207A

United States Patent [19]

Otake et al.

[11] Patent Number: 5,327,207

[45] Date of Patent: Jul. 5, 1994

[54] COPY MACHINE HAVING PLURAL TRAYS EACH TRAY CAPABLE OF STORING TWO DIFFERENT STACKS OF SHEETS

[75] Inventors: Masayuki Otake, Kakamigahara; Kiyoshi Sakamoto, Anpachi; Shuji Watanabe; Akira Inada, both of Ogaki; Nobuhiro Mabuchi, Hashima; Naoyuki Kikuchi, Ogaki; Shigeru Tanabe; Takuo Otoshi, both of Anpachi, all of Japan

[73] Assignee: Sanyo Electric Co., Ltd., Osaka, Japan

[21] Appl. No.: 978,871

[22] Filed: Nov. 19, 1992

[30] Foreign Application Priority Data

Nov. 19, 1991 [JP] Japan ..... 3-331264

[51] Int. Cl.[5] ..... G03G 21/00

[52] U.S. Cl. ..... 355/311; 355/318; 271/9; 271/225

[58] Field of Search ..... 355/318, 319, 320, 23, 355/24, 26, 48-51, 311; 271/187, 225, 3, 9

[56] References Cited

U.S. PATENT DOCUMENTS

| | | | |
|---|---|---|---|
| 4,303,235 | 12/1981 | Calabrese | 271/9 X |
| 4,650,312 | 9/1985 | Koike . | |
| 4,721,381 | 1/1988 | Matsuo | 355/24 X |
| 4,744,553 | 5/1988 | Hirose | 271/3.1 |
| 4,934,681 | 6/1990 | Holmes et al. | 271/3 |
| 5,055,880 | 10/1991 | Fujiwara | 355/235 |
| 5,221,951 | 6/1993 | Sakamoto | 355/311 |

*Primary Examiner*—R. L. Moses
*Attorney, Agent, or Firm*—Darby & Darby

[57] ABSTRACT

In a copying machine, an original which has been once exposed to be scanned is inverted and transmitted again to an original table glass, and a sheet having one face onto which an image has been fixed is inverted and then transmitted through a transmitting path to an image forming section, whereby the top and back faces of the original are copied to the top and back faces of the sheet, respectively.

18 Claims, 3 Drawing Sheets

COPY MACHINE HAVING PLURAL TRAYS EACH TRAY CAPABLE OF STORING TWO DIFFERENT STACKS OF SHEETS

BACKGROUND OF THE INVENTION

1. Field of the Invention

The present invention relates to a copying machine having a function of double-face (reflex) copying, multiple-composition copying and parallel-composition copying.

2. Description of the Related Art

Conventionally, some kinds of copying machines having multifunctions including double-face copying, etc. are provided with a sheet-feeding equipment for double-face copying which is disposed below an image forming section. The sheet-feeding equipment for double-face copying is so constructed that a copy sheet having one face onto which an image has been fixed is inverted by a face-inverting sheet supply section or not and then temporarily stocked in a sheet stock section, and that the stocked copy sheet is refed by a sheet refeeding section to the image forming section wherein an image is fixed onto the other face thereof or the copied face thereof.

With the recent office automation, the multi-functioning of copying machine has been required such as enlargement, reduction, continuous-page printing, double-face copying and multiple-composition copying. With the increased multifunctioning of copying machine, the kinds of the size of sheets to be handled are thereby increasing the number of cassettes. On the other hand, the effective utilization of office floor space has become an important issue because of the recent increase of land prices, whereby a copying machine has been required to have a small installation space in order to save floor space.

As a copying machine which reduces installation space and is capable of mounting many cassettes to the machine assembly thereof, a front loading-type copying machine has been developed. In the machine, a plurality of cassettes storing sheets has been mounted to the lower side of the machine assembly in a manner to be taken out of the front, whereby the cassettes do not protrude beyond the machine assembly to make small the installation area of the machine assembly.

In the manufacture of copying machines, copying machines not provided with a function of double-face copying are sometimes manufactured in compliance of the user's request. In this case, from the view point of the manufacture economy, copying machines which are originally so designed as to perform double-face copying are manufactured with a sheet-feeding equipment for double-face copying omitted. Such a copying machine has a problem in that the large space for mounting a sheet-feeding equipment for double-face copying is useless.

In a front loading-type copying machine, the incorporation of a sheet-feeding equipment for double-face copying requires a large mounting space to be prepared in the machine body. This causes a problem in that the maximum number of cassettes mountable in the machine body, which is an element of the multifunctioning, is restricted, thereby impeding the multifunctioning of a copying machine.

The image fixing process in the image forming section of a copying machine is performed in such a manner that a toner image obtained after the developing and transferring processes is meltingly pressed onto one face of a copy sheet by hot heat rollers. Therefore, the process of fixing an image onto one face causes a copy sheet to produce deformation such as wrinkle and curl and to change characteristic thereof. In a sheet-feeding equipment for double-face copying having the above-mentioned configuration, therefore, there arises a problem in that a sheet-feeding error is liable to occur during the process of refeeding a sheet from the sheet stock section. In order to avoid such a feeding error from occurring during the refeeding process, it is required to use expensive copy sheets having special quality in which the above-mentioned deformation and the characteristic hardly occur, thereby causing another problem that inexpensive copy sheets such as those of regenerated paper which have been widely used in recent years are restricted in the use for double-face copying, and multiple-composition copying.

SUMMARY OF THE INVENTION

An object of the invention is to provide a copying machine in which the useless space in the machine body can be reduced in volume.

Another object of the invention is to provide a copying machine in which the maximum number of cassettes mountable in the machine body can be increased to realize multifunctioning of the copy operation.

A further object of the invention is to provide a copying machine in which, even when a sheet has been deformed or changed in characteristic during the image fixing process, no feeding error occurs during the transmission and refeeding of the sheet.

A still further object of the invention is to provide a copying machine in which inexpensive copy sheets such as those of regenerated paper can be used for double-face copying.

The copying machine of the invention has means for inverting an original having one face (top face) which has been scanned to be exposed, and for transmitting again the inverted original to an exposure and scan position, and means for inverting a sheet having one face (top face) onto which an image has been fixed, and for transmitting again the inverted sheet to an image forming section, whereby the top and back faces of the original are copied onto the top and back faces of the sheet.

According to the invention, an original is at first fed from an original table to a predetermined position for optical scanning, and an image obtained by the optical scanning is transferred to a sheet and fixed thereto, whereby one face (top face) of the original is copied to one face (top face) of the sheet. Then, the original is inverted, and transmitted again to the predetermined position for optical scanning. On the other hand, the sheet having the one face (top face) to which an image has been fixed is temporarily held, and then inverted and fed to the image forming section through a transmitting path. Thereafter, an image obtained by optical scanning of the inverted original is transferred to the sheet and fixed thereto so that the other face (back face) of the original is copied to the other face (back face) of the sheet. After this process of double-face copying, the original is returned to the original table, and the above-mentioned double-face copying operation is repeated so that a plurality of double-face copied sheets are obtained. When a circulating function is utilized instead of a reverse function in the original feeding section or the sheet feeding section to the image forming section, multiple-composition, parallel-composition copied sheets are also obtained.

The above and further objects and features of the invention will more fully be apparent from the following detailed description with accompanying drawings.

DESCRIPTION OF THE PREFERRED EMBODIMENTS

Figure 1:
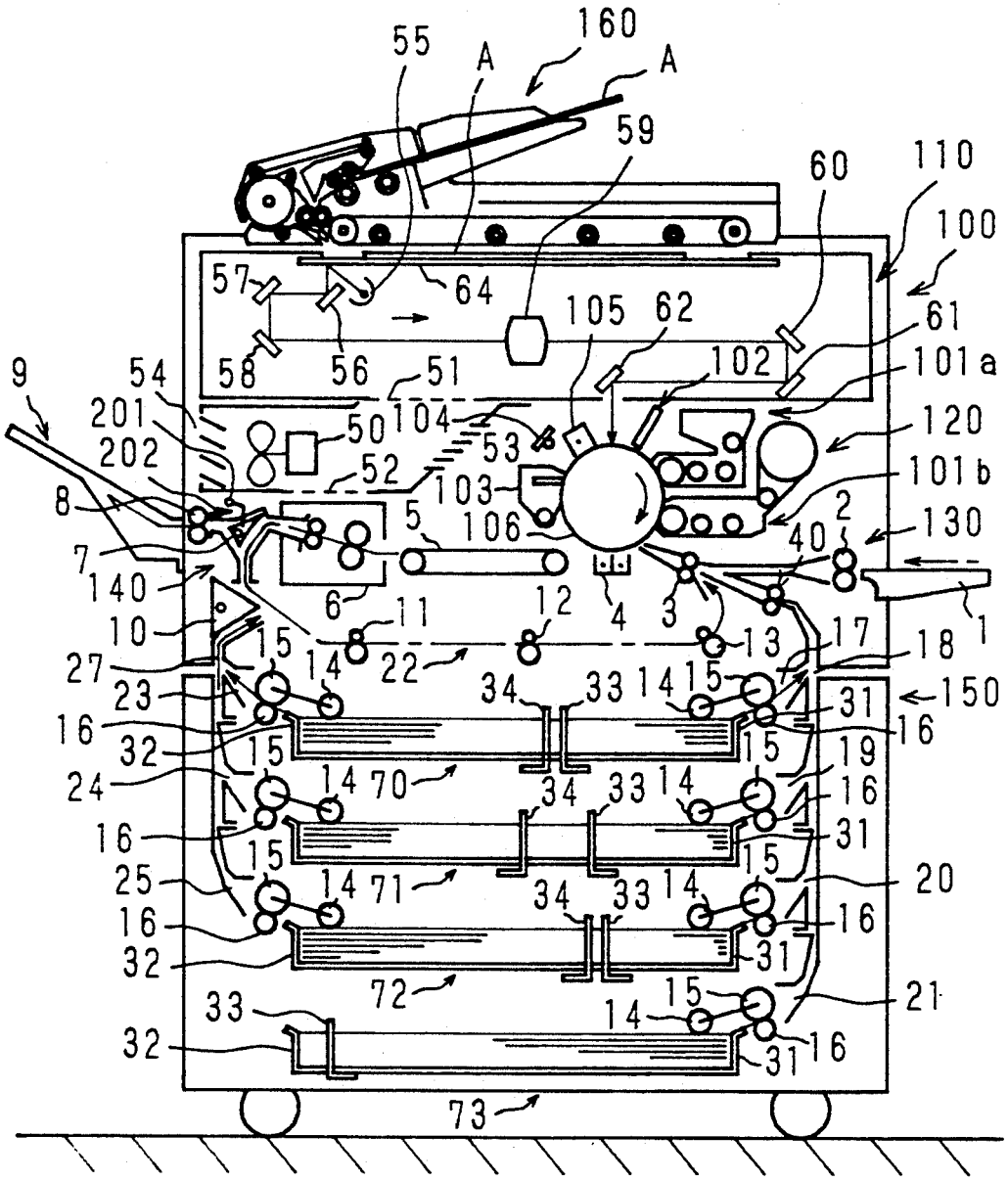
FIG. 1 is a diagrammatic longitudinal sectional view showing the whole structure of a copying machine according to the invention.

With reference to drawings showing embodiments, the present invention will be described hereinafter. The copying machine according to the invention and shown in FIG. 1 has: a machine assembly 100 which includes an optical scanner 110, an image forming section 120, a sheet-conveying section 130 and a sheet-discharging and transmitting section 140; a multiple sheet-feeding equipment 150 which supports the machine assembly 100 and feeds sheets thereto; and a circulating type automatic double-face original-feeding unit 160 which is mounted on the machine assembly 100 and by which an original is fed to and discharged from the optical scanner 110 of the machine assembly 100. The structure and general operation of the machine assembly 100 will be described below.

First, the optical scanner 110 is described. The optical scanner 110 has a light source 55 for exposing an original placed on an original table glass 64, reflecting mirrors 56, 57, 58, 60, 61, 62 for guiding the reflected light from the original table glass 64 to the exposing position on a photosensitive drum 106, and a zoom lens 59. The light source 55 and the mirror 56 move in the arrow direction at the same speed as the peripheral velocity of the photosensitive drum 106 during equal magnifying to scan the original, while the mirrors 57, 58 move at half of the velocity. During deforming-magnifying, the zoom lens 59 changes the position thereof according to magnification.

Next, the image-forming section 120 is described. The photosensitive drum 106 turns clockwise as shown with arrow and the surface thereof is coated with a photoconductive material or provided with a laminated photo-conductive material. On the periphery of the photosensitive drum 106, are disposed a charge corotron 105 for electrifying uniformly the surface of the photosensitive drum 106, an unnecessary-charge eraser 102 for erasing an unnecessary charge, two developing stations **101*a*, 101*b* for allowing toners with different colors to adhere to the photosensitive drum 106, a transfer-separation corotron 4 for transferring a toner to sheets and separating the sheets from the photosensitive drum 106, a blade-type cleaner 103 for removing the toner remaining on the photosensitive drum 106, and a remaining-charge eraser 104** for erasing the remaining charge, in this order along the turning direction shown with arrow.

The photosensitive drum 106 is electrified by the charge corotron 105, exposed by exposing and scanning, and forms a latent image by erasing the charge on the exposed area. An unnecessary charge outside image field or that at multiple-composition copying process is erased by the unnecessary-charge eraser 102; a toner is developed to the formed latent image by the developing stations **101*a*, 101*b***, whereby the latent image is made a visible image.

The developed image is transferred by the transfer-separation corotron 4 to a sheet fed with timing taken by a regist roller 3, and the sheet having been transferred is fed through a conveying unit 5 to a fixing unit 6. The fixing unit 6 meltingly fixes the toner to the sheet, which is then discharged through a flapper 7 and a discharging and inverting roller 8 of the sheet-discharging and transmitting section 140 to a discharging tray 9. When the double-face copying operation is to be conducted, the tail of the sheet conveyed from the flapper 7 to the discharging and inverting roller 8 is detected by a discharge sensor 201 disposed in the vicinity of the flapper 7. When a predetermined period of time has elapsed from this detection, the rotation direction of the discharging and inverting roller 8 is reversed so that the sheet is fed to a transmitting path 22 having rollers 11, 12 and 13, through a discharge-transmission switching flapper 202 disposed between the discharging and inverting roller 8 and the flapper 7, and also through the flapper 7 and a flapper 10. The sheet is further conveyed through the transmitting path 22 to the regist roller 3.

The flapper 7, discharging and inverting roller 8, discharging tray 9, discharge sensor 201, discharge-transmission switching flapper 202, flapper 10 and transmitting path 22 constitute the sheet-discharging and transmitting section 140. The structure and operation of the sheet-discharging and transmitting section 140 will be described in detail later.

Next, the sheet-conveying section 130 is described. On a side of the machine assembly 100, is provided a sheet-feeding bedplate 1 for inserting and feeding manually sheets. The sheet to be inserted through the sheet-feeding bedplate 1 is usually the one which cannot be fed by the multiple sheet-feeding equipment 150, and the sheet thus inserted is conveyed by a roller 2 to the regist roller 3. On the bottom of machine assembly 100, is provided two sheet-feeding openings 18, 27. The two sheet-feeding openings 18, 27 are used to take in the sheet fed from the multiple sheet-feeding equipment 150. The sheet fed from the sheet-feeding opening 18 is conveyed by a roller 40 to the regist roller 3, while the sheet fed from the sheet-feeding opening 27 is conveyed through the flapper 10 and transmitting path 22 to the regist roller 3.

The regist roller 3 is used to synchronize the sheet with the image formed on the photosensitive drum 106, and starts rotation when the head of the image on the photosensitive drum 106 reaches a specified position.

Reference numeral 50 indicates an air-sending cooler, which sends the outside air introduced from a ventilating opening 54 through air-sending openings 51, 52, 53 to the optical scanner 110, the fixing unit 6 and the photosensitive drum 106, thereby controlling the temperature of them to a proper value.

The multiple sheet-feeding equipment 150 is explained below. The sheet-feeding equipment 150 has a space for housing four cassettes 70, 71, 72, 73, whose outside dimensions are equal to each other and somewhat larger than the size of A-3 sheets. Two kinds of sheets of Letter "longitudinal" and Letter "lateral" are stored in the cassette 70. Here, "longitudinal" means a storing method with which the direction of longer sheet dimension is allowed to coincide with that of sheet-feeding, while "lateral" means a storing method with which the direction of shorter sheet dimension is allowed to coincide with that of sheet-feeding. Usually, "longitudinal" is often used to copy a deforming-magnifying image on sheets, while "lateral" is often used to perform regular copying or double-face copying.

In the cassette 71 are stored two kinds of sheets of Legal "longitudinal" and Statement "lateral", in the cassette 72 are stored two kinds of sheets of Letter "longitudinal" and Statement "longitudinal", and in the cassette 73 is stored one kind of sheets of Ledger "longitudinal". Accordingly, six cassettes have conventionally been required to store such kinds of sheets, while with the present invention, four cassettes having outside dimensions not so different from the conventional ones can store and feed so many kinds of sheets.

Near the center of the cassettes 70, 71 and 72, length-controlling plates 33 and 34 are disposed in such a manner that they are movable in the feeding direction. Sheets are stored in the spaces surrounded by the length-controlling plates, width-controlling plates (not shown) and side plates of the cassettes 70, 71 and 72. On the both sides of the cassettes 70, 71 and 72 and above an end of the cassette 73, are disposed pick-up feed rollers 14 for taking out stored sheets. A pair of sheet-feeding rollers 15 and reversely-rotating rollers 16 are disposed so as to oppose the pick-up feed rollers 14. The pick-up feed rollers 14 contact with the upper face of a sheet pushed up by a knock-up plate (not shown) and take out a sheet contacting with them. The sheet-feeding rollers 15 and reversely-rotating rollers 16 rotate in the same direction. When two or more sheets are taken out, only the sheet in contact with the sheet-feeding rollers 15 is separated from the placed sheets, and then conveyed through sheet-feeding paths 17, 23, 19, 24, 20, 25 and 21 to sheet-feeding openings 18 and 27 of the machine assembly 100. The method of taking out and separating sheets is not restricted to that of the embodiment.

The operation of feeding sheets of Letter "lateral" stored in one side of the cassette 70 will be described. Sheets are fed by the pick-up feed roller 14 to be sandwiched between the sheet-feeding roller 15 and the reversely-rotating roller 16, and separated thereby one by one. The separated sheet is conveyed through the sheet-feeding path 17 and the sheet-feeding opening 18 to the regist roller 3. The sheet is aligned at the regist roller 3 with the image formed on the photosensitive drum 106, and then conveyed between the transfer-separation corotron 4 and the photosensitive drum 106. The toner image is transferred onto the sheet, and thereafter meltingly fixed to the sheet by the fixing unit 6. The sheet is further conveyed to the discharging tray 9, whereby the copy operation for one sheet is accomplished.

The operation of feeding sheets of Letter "longitudinal" stored in the other side of the cassette 70 will be described. Sheets of Letter "longitudinal" are taken out by the pick-up feed roller 14 in the direction reverse by 180 deg. to the feeding direction of sheets of Letter size "lateral", and separated one by one by the sheet-feeding roller 15 and the reversely-rotating roller 16. The separated sheet is conveyed through the sheet-feeding path 23 and the sheet-feeding opening 27 to be switched by the flapper 10 to the transmitting path 22, is registered once at the roller 11 in the transmitting path 22, and then is conveyed to the regist roller 3. Thereafter, the copy operation is performed in the similar manner as described above.

Having explained a case where the sheets placed in the cassette 70 are separated and fed in the sheet-feeding direction reverse to each other in the above embodiment, for the cassette 70, the same effect can be obtained even if the sheet-feeding direction is the same. In this case, the sheet-feeding path is allowed to be joined to the midway point in the transmitting path 22, in which case the sheet-feeding path becomes shorter than in this embodiment, thereby allowing the first copy to be earlier obtained. In particular, if the kind of sheet of the highest frequency is stored in the cassette 70, that effect can be fully exerted.

In this embodiment, the sheet after being fixed can be guided directly to the transmitting path 22 and conveyed again to the regist roller 3, thereby allowing multiple-composition copying to be performed. Combining this with the developing stations 101*a*, 101*b* and an editor (not shown) allows two-color copying and partially converted color copying to be performed.

Figure 2:
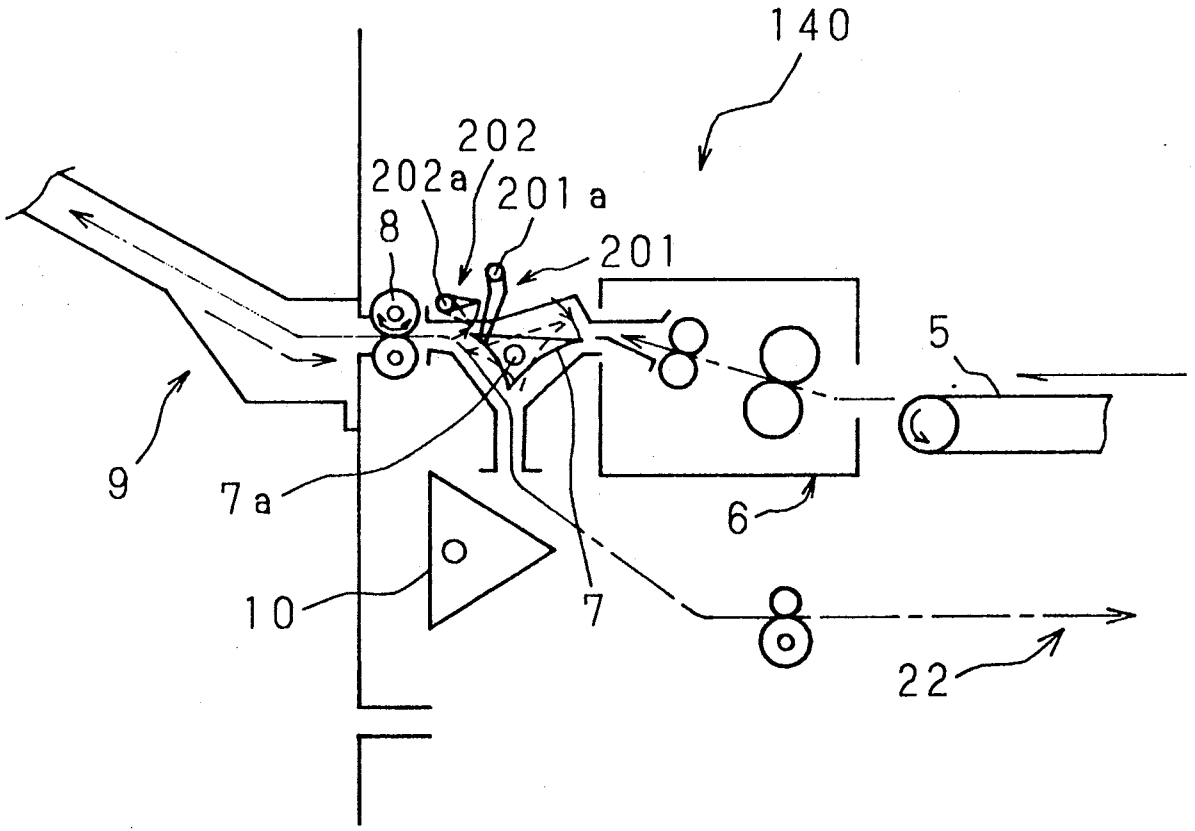
FIG. 2 is an enlarged sectional view of a sheet-discharging and transmitting section used in the copying machine of the invention.

The detail of the structure and operation of the sheet-discharging and transmitting section 140 will be described. FIG. 2 is an enlarged sectional view of the sheet-discharging and transmitting section 140.

The flapper 7 is pivotable about a shaft 7*a* in clockwise and counterclockwise directions as viewed in FIG. 2. When, in the double-face copying mode, the flapper 7 turns clockwise as shown by the solid line in the figure, it guides a sheet fed from the fixing unit 6 to the path through which the sheet will be conveyed via the discharging and inverting roller 8 to the discharging tray 9. In contrast, when, in the multiple-composition copying mode, the flapper 7 turns counterclockwise as shown by the broken line in the figure, it guides a sheet fed from the fixing unit 6 to the path through which the sheet will be transmitted via the flapper 10 and the transmitting path 22 to the regist roller 3. In this time, the roller 11 in the transmitting path 22 functions as a regist roller and regulates the oblique movement and the transmission timing of sheet.

When a sheet is guided to the path elongating via the discharging and inverting roller 8 toward the discharging tray 9 and passes over the flapper 7, the discharge sensor 201 contacts with the sheet and turns clockwise in the figure about a shaft 201*a*, with the passing of the sheet. In association with this turn operation, the discharge sensor 201 detects the tail of the sheet.

When a sheet is to be discharged, the discharging and inverting roller 8 rotates clockwise (hereinafter, this rotation is referred to as "forward rotation"), so that a sheet fed through the flapper 7 is discharged to the discharging tray 9. When the double-face copying operation is to be conducted, the discharging and inverting roller 8 at first forward rotates to discharge one portion of a sheet having one face onto which an image has been fixed, to the discharging tray 9, and, when a predetermined period of time has elapsed after the discharge sensor 201 detects the tail of the sheet, rotates counterclockwise (hereinafter, this rotation is referred to as "reverse rotation"), so that the sheet is conveyed toward the inside of the machine assembly 100.

The discharge-transmission switching flapper 202 turns in clockwise and counterclockwise directions as viewed in FIG. 2, about a shaft 202*a* which is disposed above the sheet conveying path elongating between the flapper 7 and the discharging and inverting roller 8. When the discharging and inverting roller 8 reversely rotates, the flapper 202 turns clockwise as shown by the broken line in the figure and stops in the state where its tip enters the sheet conveying path and faces the flapper 7. In contrast, when the discharging and inverting roller 8 forward rotates, the flapper 202 turns counterclockwise as shown by the solid line in the figure and stops in the state where its tip stays above the sheet conveying path.

According to the above-described configuration, the sheet discharge operation is performed by the sheet-discharging and transmitting section 140 in such a manner that a sheet fed from the fixing unit 6 passes over the flapper 7 and the forward rotation of the discharging and inverting roller 8 causes the sheet to be discharged to the discharging tray 9.

When the double-face copying operation is to be conducted, a sheet having one face onto which an image has been fixed passes over the flapper 7 and is partly discharged to the discharging tray 9 by the forward rotation of the discharging and inverting roller 8, and the discharge sensor 201 detects the tail of the sheet. When the predetermined period of time has elapsed after this detection, the discharging and inverting roller 8 reversely rotates, and at the same time the discharge-transmission switching flapper 202 enters the sheet conveying path, so that the sheet passes the path below and at the left side of the flapper 7 as viewed in the figure to be fed via the flapper 10 to the transmitting path 22, and is further conveyed through the transmitting path 22 to the regist roller 3. This causes the sheet to reach the regist roller 3 while being inverted.

In the case that one of various multiple-composition or parallel-composition operations such as partial-color copying for obtaining a two-color image or edition copying is to be conducted, a sheet to which, for example, unicolor image has been fixed and which is fed from the fixing unit 6 moves the path below and at the right side of the flapper 7 as viewed in the figure to be fed via the flapper 10 to the transmitting path 22, and is further conveyed through the transmitting path 22 to the regist roller 3.

Figure 3:
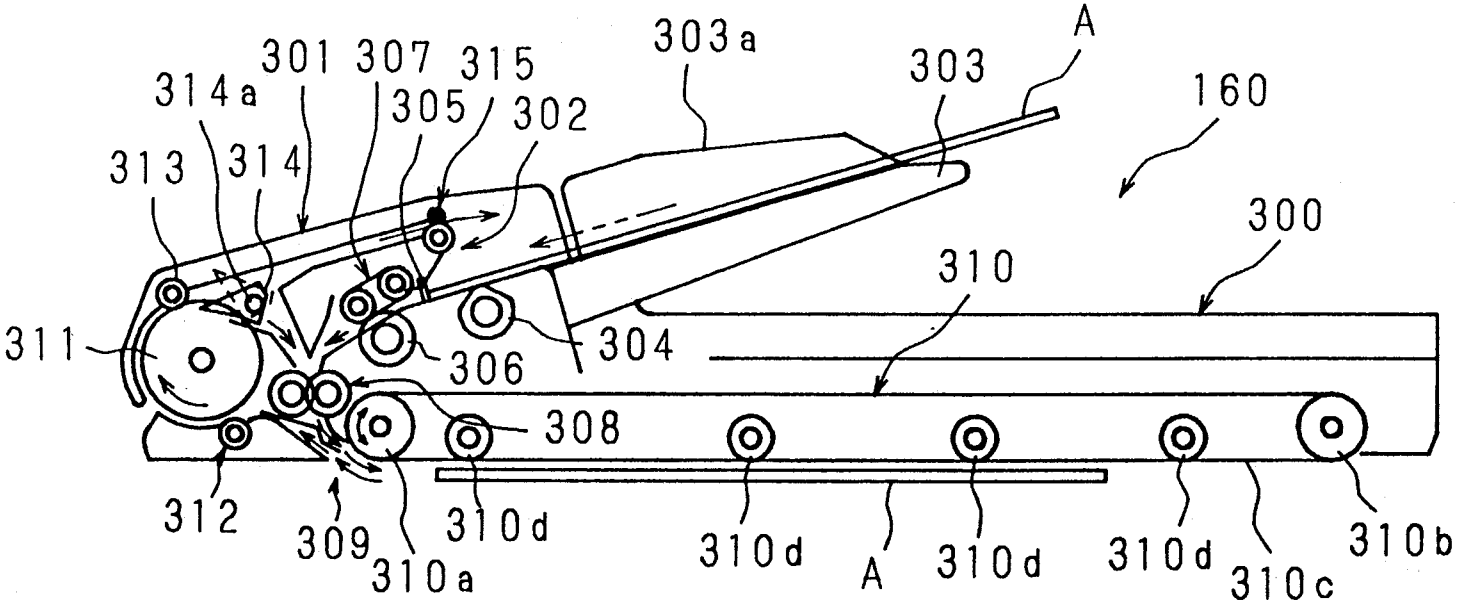
FIG. 3 is an enlarged sectional view of a circulating type automatic double-face original-feeding unit used in the copying machine of the invention.

Next, the configuration of the circulating type automatic double-face original-feeding unit 160 will be described. FIG. 3 is an enlarged sectional view of the circulating type automatic double-face original-feeding unit 160.

The circulating type automatic double-face original-feeding unit 160 has a rectangular plate-like cover section 300 which functions as a cover for the original table glass 64, and an original-returning mechanism storing section 301 which stores an original-returning mechanism therein and has a cone-shaped section. The storing section 301 is disposed at a portion of the cover section 300 which is in the side of the discharging tray 9, in such a manner that it protrudes upward. An original insertion slot 302 opens at a portion of the original-returning mechanism storing section 301 which corresponds to the center portion of the cover section 300. In the vicinity of the opening of the original insertion slot 302, an original table 303 on which a plurality of originals A can be stacked is obliquely mounted. Width-controlling plates 303*a* for aligning stacked originals in the width direction are disposed on the upper face of the original table 303.

The internal space of the original-returning mechanism storing section 301 extends downward and obliquely from the original insertion slot 302 toward the end of the cover section 300 in the side of the discharging tray 9. The original-returning mechanism consisting of various rollers, flappers, etc. is disposed in the internal space. In the internal space of the original-returning mechanism storing section 301, an original-feeding roller 304 by which the originals A on the original table 303 are conveyed one by one, a stopper plate 305 for aligning the front edges of the originals A on the original table 303, and an intermediate roller 306 by which the original A conveyed through the original-feeding roller 304 is further conveyed toward the internal space are disposed in this sequence from the opening side of the original insertion slot 302 toward the internal side.

Above the intermediate roller 306, a separation belt 307 is disposed in such a manner that it contacts with the intermediate roller 306. When two or more originals A are simultaneously fed from the original-feeding roller 304, the separation belt 307 separates them one by one. The original A fed from the original-feeding roller 304 is further fed toward the internal space while being sandwiched between the intermediate roller 306 and the separation belt 307. A pair of regist rollers 308 for forming a loop of the original A and preventing the original A from obliquely moving are disposed at a position inner than that of the intermediate roller 306, in such a manner that they horizontally oppose to each other. In the discharging side (lower side) of the regist rollers 308, disposed is an original discharge slot 309 which opens on the lower face of the cover section 300, so that the original discharged from the regist rollers 308 is fed through the original discharge slot 309 to the lower face of the cover section 300.

A conveyor belt 310 is disposed on the lower face of the cover section 300. The conveyor belt 310 conveys the original A fed to the lower face of the cover section 300 through the original discharge slot 309, to the original table glass 64 (see FIG. 1). The conveyor belt 310 is so constructed that a belt 310*c* is wound between a driving roller 310*a* disposed in the opening portion of the original discharge slot 309 and a driven roller 310*c* disposed in the end portion of the lower face of the cover section 300 at the side of the sheet-feeding bedplate 1, and that the belt 301*c* is pressed to the original table glass 64 by a plurality of pressure rollers 310*d* which are arranged at adequate intervals between the driving roller 310*a* and the driven roller 310*b*.

When the driving roller 310*a* reversely rotates as viewed in the figure, the movement of the belt 310*c* causes the original A contacting with the belt 310*c* to be fed onto the original table glass 64. In contrast, when the driving roller 310*a* forward rotates as viewed in the figure, the movement of the belt 310*c* causes the original A contacting with the belt 310*c* to be returned from the original table glass 64 into the original discharge slot 309.

At a position of the internal space of the original-returning mechanism storing section 301 where is deeper than that of the regist rollers 308, disposed is a reversely-rotating roller 311 of a large diameter which inverts the original A that has been returned into the original discharge slot 309 and which refeeds the inverted original to the regist rollers 308. A first auxiliary roller 312 of a small diameter is disposed below the reversely-rotating roller 311 so as to contact with the lower portion thereof, and a second auxiliary roller 313 of a small diameter is disposed above the reversely-rotating roller 311 so as to contact with the upper portion thereof. The original returned into the original discharge slot 309 is fed in the internal space of the original-returning mechanism storing section 301 toward the opening of the original insertion slot 302, while passing between the reversely-rotating roller 311 and the first auxiliary roller 312, between the reversely-rotating roller 311 and the inner wall of the internal space of the original-returning mechanism storing section 301, and between the reversely-rotating roller 311 and the second auxiliary roller 313.

In the discharging side of the reversely-rotating roller 311 and the second auxiliary roller 313, disposed is a discharge-refeed switching flapper 314 which has a front end directed to this discharging side and turns about a shaft 314*a* in clockwise and counterclockwise directions as viewed in FIG. 3. The discharge-refeed switching flapper 314 turns clockwise when the double-face copying operation is to be conducted, and turns counterclockwise when the double-face copying operation for one original has been completed and when the single-face copying operation is to be conducted.

When the discharge-refeed switching flapper 314 turns clockwise, it is positioned as shown by the broken line in the figure so that the original A fed from the discharging side of the reversely-rotating roller 311 and the second auxiliary roller 313 is refed to the regist rollers 308. In contrast, when the discharge-refeed switching flapper 314 turns counterclockwise, it is positioned as shown by the solid line in the figure so that the original A fed from the discharging side of the reversely-rotating roller 311 and the second auxiliary roller 313 is fed along the upper wall of the internal space of the original-returning mechanism storing section 301 toward the opening of the original insertion slot 302, and then discharged from a pair of discharge rollers 315 disposed above the opening of the original insertion slot 302 and in the side of the upper wall, onto the original table 303.

When the double-face copying operation is to be conducted in the circulating type automatic double-face original-feeding unit 160 having the configuration described above, one of the originals A on the original table 303 is fed onto the original table glass 64. Then, the lower face (top face) of the fed original A is optically scanned, and after this optical scanning the original A is fed to the reversely-rotating roller 311. In this case, the discharge-refeed switching flapper 314 is positioned as shown by the broken line in the figure so that the original A fed from the reversely-rotating roller 311 is refed onto the original table glass 64 by the regist rollers 308 and the conveyor belt 310. The original A fed in this way onto the original table glass 64 through the reversely-rotating roller 311 has the state that is the inversion of that obtained when the original A which has been initially fed onto the original table glass 64. Then, the lower face (back face) of the inverted original A is optically scanned, and after this optical scanning the original A is fed to the reversely-rotating roller 311. In this case, the discharge-refeed switching flapper 314 is positioned as shown by the solid line in the figure so that the original A fed from the reversely-rotating roller 311 is discharged onto the original table 303 by the discharge rollers 315.

As described above, when the double-face copying operation is to be conducted, the original A on the original table 303 is fed onto the original table glass 64 with its top face directed downward, then refed onto the original table glass 64 with its back face directed downward, and thereafter returned onto the original table 303.

In the thus configured copying machine, the timing of the operation of returning the original A which is performed by the circulating type automatic double-face original-feeding unit 160 is synchronized with the timing of the operations performed by the optical scanner 110, image forming section 120, sheet-conveying section 130 and sheet-discharging and transmitting section 140, thereby allowing the double-face copying operation to be conducted in which the top face of the original A is copied to the top face of the sheet and the back face of the original A is then copied to the back face of the sheet.

Furthermore, in the multiple-composition or parallel-composition copying wherein a double-face original or two single-face originals are copied to a sheet, the sorting of hard copy such as partial-color copying or edition copying can be executed by the use of color developing station or editor.

The above-described operation of returning the original A may be repeated plural times while conducting the double-face copying and multiple-composition copying operation, so that the double-face copying and multiple-composition copying operation is executed for a plural number of sheets in such a manner that the copied sheets are sorted in page order of every set. Since a plurality of originals A can be placed on the original table 303, moreover, it is possible to continuously obtain a required number of double-face copies and multiple-composition copies of the plurality of originals A.

As described above, according to the invention, it is not necessary a sheet stock section which has been required for the double-face copying operation and so forth in a prior art copying machine, whereby the useless space in the machine body can be reduced in volume. As a result, it is possible to increase the maximum number of cassettes mountable in the machine body as compared with a prior art copying machine, so that multifunctioning of the copy operation is realized. Sheets are transmitted to the image section and without refeeding sheets from a sheet stock section, and therefore, even when a sheet has been deformed or changed in characteristic in the fixing process, no feeding error occurs during the transmission of sheets. This allows inexpensive copy sheets such as those of regenerated paper to be used for double-face copying and multi-composition copying.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A copying machine for copying front and back faces of an original to a sheet, comprising:

means for feeding the original to a predetermined position;

means for optically scanning the original at said predetermined position to obtain an image;

sheet-feeding means for feeding the sheet, said sheet-feeding means including a tray having opposing sides for storing a stack of each of two kinds of sheets;

take out means for selectively taking out sheets separately from each stack in a respective different direction from the respective adjacent opposing side of said tray;

means for transferring said image onto the fed sheet;

fixing means for fixing the transferred image to the sheet;

first transmitting means for inverting the original fed to said predetermined position, and for transmitting the inverted original to said original-feeding means;

second transmitting means for transmitting the sheet to said sheet-feeding means.

2. A copying machine according to claim 1, wherein said second transmitting means includes means for inverting the sheet.

3. A copying machine according to claim 2, wherein said second transmitting means further includes:

a roller, which is rotatable in two directions, the sheet, onto which the image has been fixed, being discharged outside a predetermined transmitting path by the rotation of said roller in one direction, the discharged sheet being transmitted by the rotation of said roller in the other direction to a path directed to said sheet-feeding means; and a flapper having a front end, said front end one of entering into and retracting from a sheet path from said fixing means, in association with the rotation direction of said roller.

4. A copying machine according to claim 3, wherein said second transmitting means further includes a sensor for detecting the passage of the sheet onto which the image has been fixed, said sensor being disposed in the path for the sheet from said fixing means, and when a predetermined period of time has elapsed after said sensor detects the sheet, the rotation direction of said rotating roller is changed from the one direction to the other direction.

5. A copying machine according to claim 1, wherein said original-feeding means includes a regist roller for forming a loop of the original.

6. A copying machine according to claim 1, wherein said second transmitting means includes a regist roller for forming a loop of the sheet.

7. A copying machine according to claim 1, further comprising:

a table having means for receiving the original;

original-returning means for returning the original from said predetermined position, to said table, said first transmitting means being disposed at an intermediate portion of said original-returning means; and a transmitting path for a sheet, said transmitting path being between said second transmitting means and said sheet-feeding means.

8. A copy machine according to claim 1 wherein said stacks store two kinds of sheets of different size.

9. A copy machine according to claim 1 wherein said stacks store two kinds of sheets arranged in different storing directions.

10. A copying machine for respectively copying front and back faces of an original to front and back faces of a sheet, comprising means for optically scanning the original at a predetermined position to obtain an image;

sheet-feeding means for feeding the sheet, said sheet-feeding means including a tray having opposing sides for storing a stack of each of two kinds of sheets;

take out means for selectively taking out sheets separately from each stack in a respective different direction from the respective adjacent opposing side of said tray;

means for transferring said image onto the fed sheet;

fixing means for fixing the transferred image to the sheet;

a transmitting path for transmitting the sheet onto which the image has been fixed, to said sheet-feeding means;

a table having means for receiving the original;

original-feeding means for feeding the original from said to said predetermined position;

original-returning means for returning the original from said predetermined position to said table first transmitting means, disposed at an intermediate portion of said original-returning means, for inverting the returned original, and for transmitting the inverted original to said original-feeding means;

second transmitting means, disposed between said fixing means and said transmitting path, for transmitting the sheet to said transmitting path.

11. A copying machine according to claim 10, wherein said first transmitting means includes a flapper rotatable in two directions for guiding the original to the path toward said original-feeding means and the path toward said table.

12. A copying machine according to claim 10, wherein said second transmitting means includes:

a roller, which is rotatable in two directions, the sheet onto which the image has been fixed, being discharged outside a predetermined transmitting path by the rotation of said roller in one direction, the discharged sheet being transmitted by the rotation of said roller in the other direction to said transmitting path; and a flapper having a front end, said front end entering into or retracting from a sheet path from said fixing means, in association with the rotation direction of said roller.

13. A copying machine according to claim 12, wherein said second transmitting means further includes a sensor for detecting the passage of the sheet onto which the image has been fixed, said sensor being disposed in the path for the sheet from said fixing means, and when a predetermined period of time has elapsed after said sensor detects the sheet, the rotation direction of said rotating roller is changed from the one direction to the other direction.

14. A copying machine according to claim 10, further comprising means for feeding the sheet stored in one of said two stacks through said transmitting path to said sheet-feeding means.

15. A copy machine according to claim 10 wherein said stacks store two kinds of sheets of different size.

16. A copy machine according to claim 10 wherein said stacks store two kinds of sheets arranged in different storing directions.

17. A copying machine for copying two originals of an odd-number one and an even-number one stacked in order to one face of a sheet, comprising:

a table having means for receiving the originals;

means for feeding the original, received on said table, to a predetermined position;

means for optically scanning the original fed, to said predetermined position, to obtain an image;

sheet-feeding means for feeding the sheet, said sheet-feeding means including a tray having opposing sides for storing a stack of each of two kinds of sheets either of different sizes or arranged in different storing directions;

take out means for selectively taking out sheets separately from each stack in a respective different direction from the respective adjacent opposing side of said tray;

means for transferring said image onto the fed sheet;

fixing means for fixing the transferred image to the sheet;

a transmitting path for transmitting the sheet onto which the image has been fixed, to said sheet-feeding means; and original-returning means for returning the original from said predetermined position, to said table, and for stacking the returned original on other originals.

18. A copying machine according to claim 17 further comprising means for feeding the sheet stored in one of said two stacks through said transmitting path to said sheet-feeding means.

* * * * *